US007648320B2

(12) United States Patent
Valli

(10) Patent No.: US 7,648,320 B2
(45) Date of Patent: Jan. 19, 2010

(54) CARRIAGE FOR THE HORIZONTAL TRANSFER OF MOTOR VEHICLES IN AUTOMATIC MECHANICAL CAR PARKS

(75) Inventor: Giovanni Valli, Cantello (IT)

(73) Assignee: Sotefin S.A., Schubelbach (CH)

( * ) Notice: Subject to any disclaimer, the term of this patent is extended or adjusted under 35 U.S.C. 154(b) by 1170 days.

(21) Appl. No.: 10/467,414

(22) PCT Filed: Mar. 13, 2002

(86) PCT No.: PCT/IB02/00786

§ 371 (c)(1),
(2), (4) Date: Aug. 8, 2003

(87) PCT Pub. No.: WO02/075084

PCT Pub. Date: Sep. 26, 2002

(65) Prior Publication Data

US 2004/0071532 A1 Apr. 15, 2004

(30) Foreign Application Priority Data

Mar. 15, 2001 (CH) ..... 0473/01

(51) Int. Cl.
*E04H 6/00* (2006.01)
*B60B 29/00* (2006.01)

(52) U.S. Cl. ..... 414/254; 414/256; 414/429; 254/89 R

(58) Field of Classification Search ..... 414/234, 414/254, 256, 263, 429, 239
See application file for complete search history.

(56) References Cited

U.S. PATENT DOCUMENTS 2,840,248 A * 6/1958 Grove et al. ..... 414/256
3,159,293 A * 12/1964 Bianca ..... 414/429
3,174,638 A * 3/1965 Dechant ..... 414/429
3,301,413 A * 1/1967 Coursey ..... 414/254
3,896,955 A 7/1975 Collins et al.
4,793,760 A * 12/1988 Valli ..... 414/254
5,037,263 A * 8/1991 Yamashita ..... 414/254
5,148,752 A * 9/1992 Yamashita ..... 104/44
5,669,753 A * 9/1997 Schween ..... 414/800
5,851,098 A * 12/1998 Buckenauer et al. ..... 414/263
6,042,321 A * 3/2000 Labell ..... 414/276
6,662,077 B2 * 12/2003 Haag ..... 700/217

FOREIGN PATENT DOCUMENTS

EP 0 430 892 6/1991
GB 1 426 081 2/1976

* cited by examiner

*Primary Examiner*—Gregory W Adams
(74) *Attorney, Agent, or Firm*—Young & Thompson

(57) ABSTRACT

Self-propelled carriage on wheels comprises:

one or two pairs of supporting elements for the wheels of either or both of the axles of the motor vehicle, these elements being movable symmetrically and perpendicularly with respect to the longitudinal axis of the carriage and designed to center, immobilize and lift from beneath the wheels;

elements for limiting the mass to be transferred;

elements for sensing, continuously during the transfer, the translational position of the carriage;

elements for sensing the presence of the motor vehicle on the carriage and measuring the front and rear lengths of the motor vehicle relative to its front axle; and elements for sensing excessive displacement of the longitudinal axis of the motor vehicle relative to the longitudinal axis of the carriage when the motor vehicle is being positioned by the user in the entrance bay.

3 Claims, 7 Drawing Sheets

28
60
29
34
19'
21'
18'
59
58
20
30
18
21
19
1
B
23'
22'
23
22
20'

CARRIAGE FOR THE HORIZONTAL TRANSFER OF MOTOR VEHICLES IN AUTOMATIC MECHANICAL CAR PARKS

BACKGROUND OF THE INVENTION

The present invention relates to automatic mechanical car parks. Such car parks generally consist of a containment building, with a reinforced-concrete or steel structure, installed in which are the necessary handling systems and machinery, with automatic collection from the entrance bay, where the user leaves the motor vehicle, and automatic return to the user at the exit bay, of motor vehicle which are contained within the said building throughout the parking period. To be specific, the present invention relates to one of the systems normally used in handling motor vehicles in this field, namely a carriage for the horizontal transfer of the motor vehicles from the parking bay (or from the entrance bay) to a handling platform, the function of which is to transport the carriage, with or without a motor vehicle, between the parking bay and the entrance and exit bays, or from a handling platform to the parking bay (or to the exit bay). During transfer of the vehicle, the handling platform, on which the carriage is normally parked, and the parking bay (or the entrance or exit bay) involved in the transfer, lie in the same plane and their respective longitudinal axes, in the line of the transfer movement, are aligned.

As regards known carriages and accessory systems, the following may be cited as the more significant of the prior art: EP 430892, EP 236278, EP 875644, EP 933493, WO 96/05390, WO 88/04350, DE 3820891, DE 19741638, U.S. Pat. Nos. 5,148,752, 3,159,293, 2,890,802.

None of these satisfactorily solves all of the problems connected with reliable transfer of the motor vehicle, speed of transfer, minimization of the space necessary for transferring and parking the motor vehicle, and minimization of the combined cost of the carriage and associated systems for transferring and parking the motor vehicle.

SUMMARY OF THE INVENTION

The object of the present invention is therefore to solve all of these problems in such a way as to provide a carriage that is innovative in the sum of the distinguishing characteristics which make it optimal for carrying out its functions and for overcoming the limits of the prior art.

These distinguishing characteristics are as follows:

Reliability of transfer of the motor vehicle:

- Critical is the method of locking on to the motor vehicle which, according to the present invention, is lifted only via its wheels from beneath, so as to reproduce as far as possible its normal operating condition.
- The wheels of the motor vehicle are locked by the carriage during the transfer in such a way that it does not matter whether or not the handbrake and any gear are or are not engaged, no problems of any kind arising from this during transfer of the motor vehicle.
- The mass to be transferred is automatically limited by the carriage in order to avoid damage or malfunction caused by vehicles that may be too heavy.
- When the carriage is transferring the motor vehicle from the entrance bay, as it positions itself underneath the motor vehicle there is a risk that, if the motor vehicle has been left by the user with its longitudinal axis very far from the longitudinal axis of the carriage and if the vehicle has not first been centred by means independent of the carriage, it may interfere, in its movement, with a wheel of the vehicle and get stuck against the tyre; for which reason the width of the carriage of the present invention or at any rate the width of that part of the carriage which rises above the height of the bottoms of the wheels of the vehicle, is made very small so as to allow a generous tolerance of displacement of the longitudinal axis of the motor vehicle from that of the carriage. Systems are also provided to help the user to position the motor vehicle in the entrance bay so that its longitudinal axis is as closely as possible aligned with the longitudinal axis of the carriage.

Speed of transfer of the motor vehicle:

- Given the same acceleration and speed of translational movement of the carriage—which however, within certain limits, can be greater the more securely the vehicle is clamped to the carriage, —the overall speed of transfer is greater if the method of lifting the motor vehicle is such as to minimize this time, and therefore, according to the present invention, this lifting action is carried out simultaneously on all four wheels of the vehicle, following positioning of the carriage underneath the vehicle in one step, rather than first on the two wheels of one axle and then on the two wheels of the other.
- The shorter the vertical lifting stroke permitted by the design of the carriage, the less time is needed to carry out this function, and therefore, in the carriage of the present invention, the vertical stroke is minimized.
- The time required to centre the motor vehicle in the carriage of the present invention is superimposed on the time used for another function of the cycle of the carriage. This reduces the total cycle time and increases the speed of transfer of the motor vehicle.

Minimization of the amount of space required for transferring and parking the motor vehicle:

- For the same maximum dimensions of motor vehicles to be stored, the carriage of the present invention allows the parking bays to be very small.
- On this subject:
- The width is minimized by the longitudinal alignment of the motor vehicle in the line of the transfer movement (centring).
- To minimize the length, the carriage is designed to allow the vehicle to be released in the parking bay in a variable position depending on the length of the vehicle itself.
- To minimize the height, the carriage is the lowest it can be for the vehicle to be able to park, when the carriage is inserted beneath it, with its four wheels resting on a surface only slightly higher than the surface supporting the carriage or supporting the systems that will be carrying it; also, the design of the carriage is such as to allow a very small vertical travel when lifting the four wheels of the motor vehicle off the surface on which they are standing.

Minimization of the combined cost of the carriage and associated systems for transferring and parking the motor vehicle:

- There are functions, such as for example that of centring or that of limiting the load, which at present are performed by dedicated systems, separate from the carriage, but obviously with the increased costs of providing housings and additional supports. It is therefore advantageous that the carriage according to the present invention is able as far as possible autonomously to perform not only its own functions, i.e. transferring the vehicle, but the accessory functions as well.

In addition, the biggest cost is represented by the systems that park the vehicles in the parking bays, which, although being "other" than the carriage, must be regarded as a consequence of the design of the carriage itself; and the latter is therefore designed, in the present invention, in such a way as also to minimize the cost of these systems.

The present invention possesses all the optimal characteristics indicated above and is advantageous when compared with all the known inventions cited.

In particular, compared with EP 430892, it has the advantage of greater reliability in the transfer of the motor vehicle because it limits the mass of this motor vehicle and includes the systems for helping the user to position the motor vehicle more accurately in the entrance bay; the advantage, too, of a faster transfer because, without modifying any of the other conditions influencing the length of time required for the transfer cycle to be carried out, it allows a shorter vertical lifting stroke; then, too, the advantage of making it possible for the motor vehicle parking bays to be shorter because it includes systems for sensing the size of the conveyed motor vehicle and for sensing the translational position of the carriage in order that the vehicle can be released in a variable position depending on the length of the vehicle, as well as for the height of the motor vehicle parking bays to be lower due to the design of the carriage which allows lowering of the height, relative to the floor of the parking bay, to which the wheels of the motor vehicle are lifted during the transfer; and lastly, the advantage of a lower combined cost of the carriage and associated systems for transferring and parking the motor vehicle, in that the systems for parking vehicles in the parking bays, which in EP 430892 are highly complicated and expensive, being unable simply to be stood on the floor of the parking bay but having to work cantilever-fashion, can be much simpler and less expensive because they simply stand on the floor of the parking bay.

These and other advantages will be evident from the description of the preferred form of construction and from the characteristics listed in the appended claims.

BREIF DESCRIPTION OF THE DRAWINGS

The preferred, but not limiting, form of construction of the invention is described below with reference to the accompanying drawings, in which:

FIG. 1 is a plan view of the transfer carriage according to the invention, positioned on a handling platform 52 with the means 58 and 59 for supporting the wheels of the motor vehicle in the retracted position inside the carriage itself.

DESCRIPTION OF THE PREFERRED EMBODIMENTS

Figure 1:
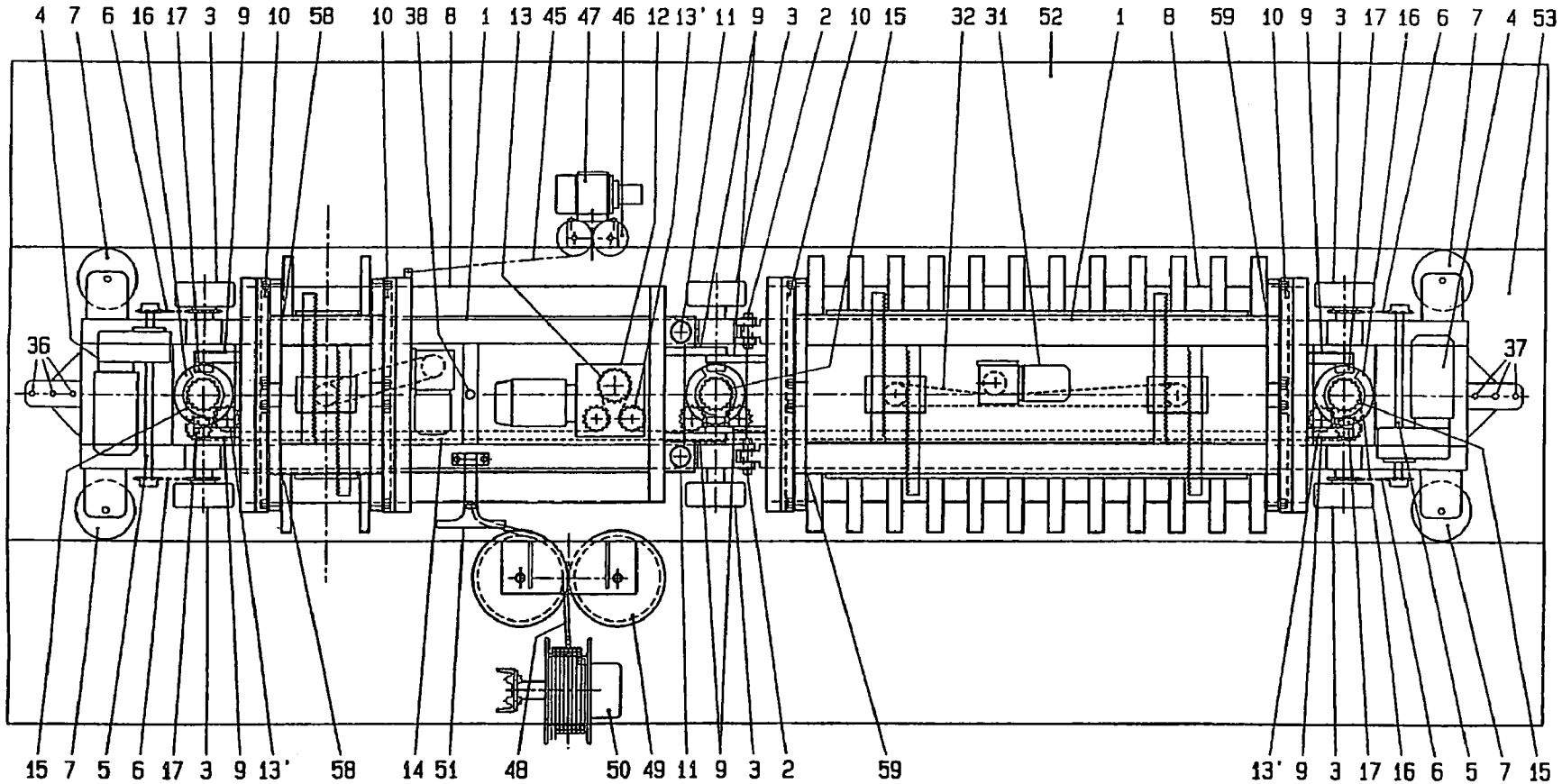

Referring to the drawings, the carriage consists of an articulated frame 1 with hinges and hinge pins 2 to permit relative rotation between the front and rear parts into which the said frame 1 is divided. The front part has four wheels 3, two of which are driving wheels driven by a motor/speed reducer assembly 4 via a shaft 5 and a chain and toothed wheel system 6, while the rear part has two driving wheels 3 driven as described above.

The said frame 1 is guided by four rollers 7 acting on the two sides of the trench 53 which is sunk into the entrance and exit bays, the handling platform, and the parking bays.

Electrical power and the signals are supplied to the carriage via a suitable electrical cable 48 which is wound onto a cable reel 50 installed on the handling platform 52, and is attached to the carriage by a shaped support 51 and guided by pulleys 49.

The instantaneous position of the carriage, in the direction of longitudinal translation, is known by means of a rotating electronic system 47 mounted on the handling platform 52 to decode the linear displacement of a rope 45 attached to the frame 1 and guided by the pulleys 46.

This system may conveniently be replaced with other electronic systems suitable for the purpose, e.g. one or more laser signal emitters installed on the carriage and aimed at a fixed reflective surface so as to measure the instantaneous distance between the emitting surface and the reflecting surface.

On each of the front and rear parts of the frame 1 is a frame 8 that can be moved vertically with respect to the frame 1. Acting via the toothed wheel 13, the deflecting toothed wheels 13' and the chain 14, the motor/speed reducer assembly 12 simultaneously turns the toothed wheels 15 and hence the axial cams 16, of which there are three and which are positioned on the longitudinal axis of the carriage and are capable of lifting both frames 8, which are borne by the cams, via pairs of arms 9 and steel wheels on roller bearings 17.

The said cams 16 each have two identical straight helical surfaces rotated through 180°, on which, as the cams rotate, the three pairs of wheels 17 connected to the arms 9 roll and are raised or lowered. The arms 9, being positioned symmetrically at a certain distance from the longitudinal axis of the carriage, provide stability to the frames 8.

In order partly to further stabilize the frames 8 against potential loads that may be eccentric with respect to the longitudinal axis of the carriage, and partly to connect the frames 8 one-to-one with the frame 1, two pins 11 are fixed to the frame 1, and two bronze bushes 11' integral with the front frame 8 run vertically on these.

A pair of opposing frames 58 are positioned on the two frames 8 to support the wheels 22 and 22' of the front axle of the motor vehicle, and similarly a pair of opposing frames 59 to support the wheels 23 and 23' of the rear axle of the motor vehicle.

Each frame of these pairs of frames 58 and 59 is made up of a centring bar 18 or 18' designed to act horizontally against the inner side wall of the wheels 22, 23 or 22', 23'.

Each bar 18, 18' has metal supports 19, 19' situated beneath and perpendicular to the said bar so as to raise the wheels 22, 23 and 22', 23', respectively, by engaging them from beneath.

Each frame of these pairs 58 and 59 is moved horizontally, symmetrically with respect to the longitudinal axis of the carriage with the opposite frame, by means of the racks 20, 20', the toothed wheels 30, the motor/speed reducer assembly 31 and the chain 32.

The said frames are also equipped with balancing bars 24 and 24' which engage with the guide 10 of the frame 8 via the rollers 25, 26 and 25', 26' to give stability and guided movement to the frames.

Figure 2:
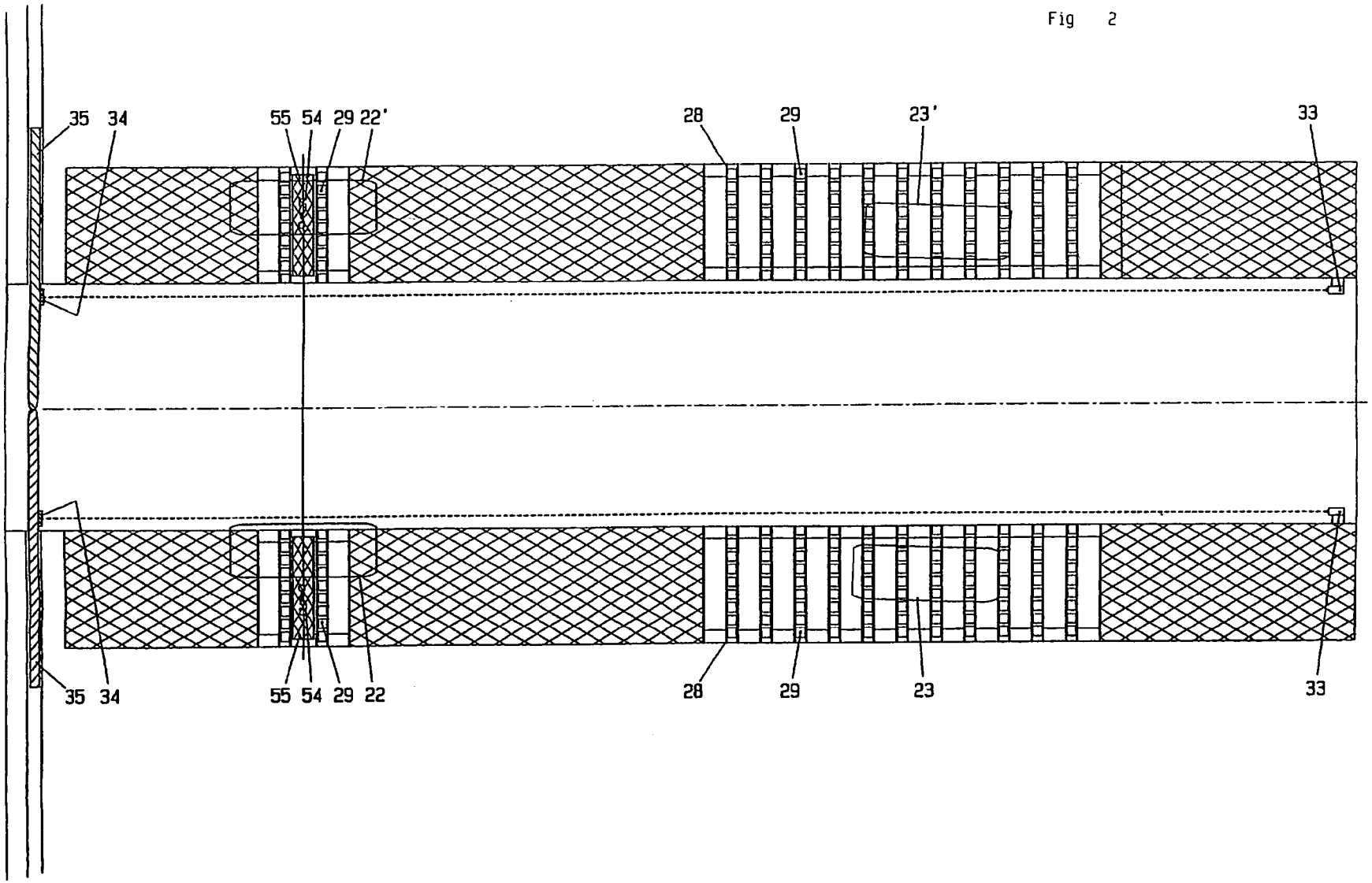
FIG. 2 is a plan view of an entrance bay.
Figure 3:
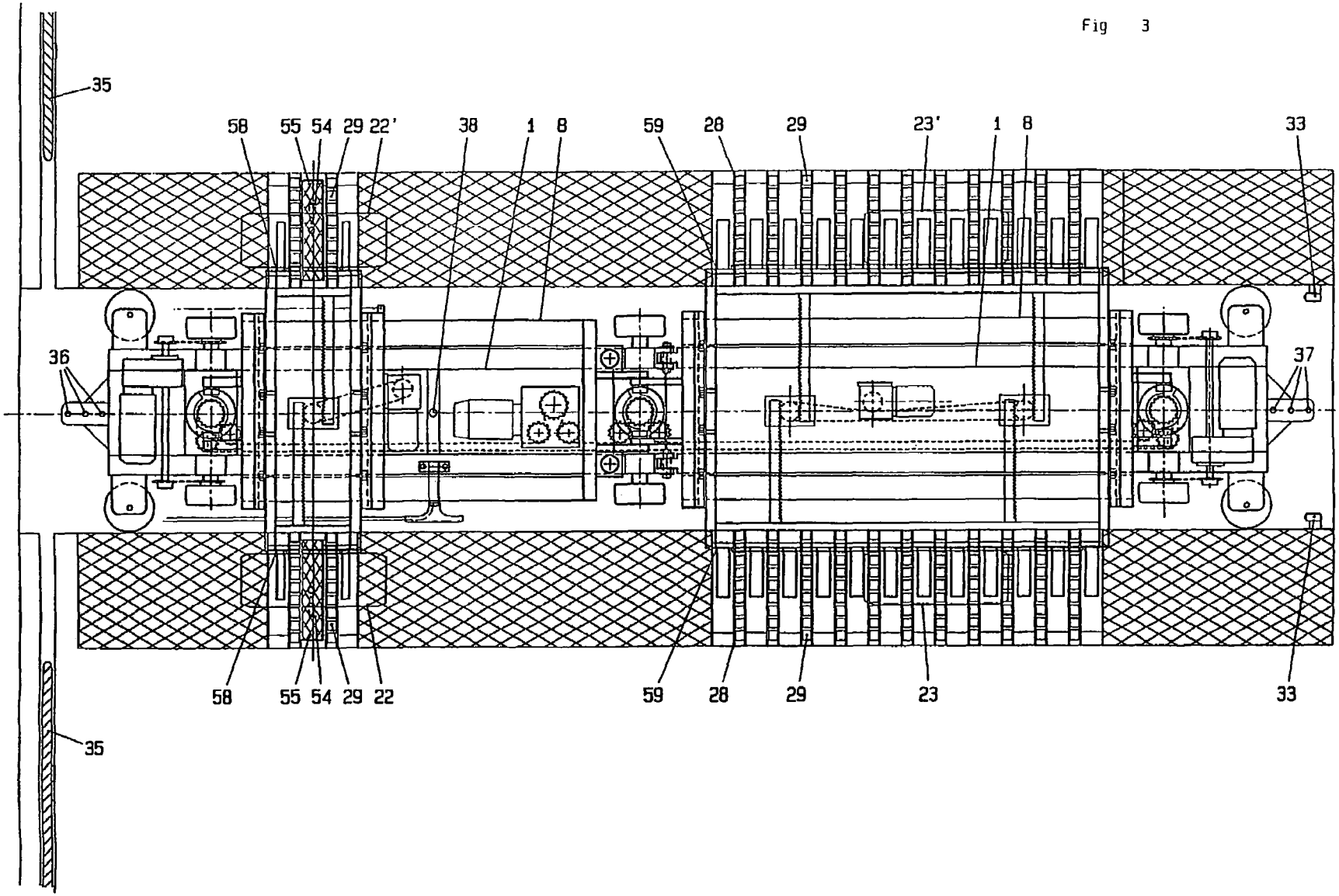
FIG. 3 is a plan view of the carriage positioned in the entrance bay with the means for supporting the wheels of the motor vehicle in the extended position.
Figure 4:
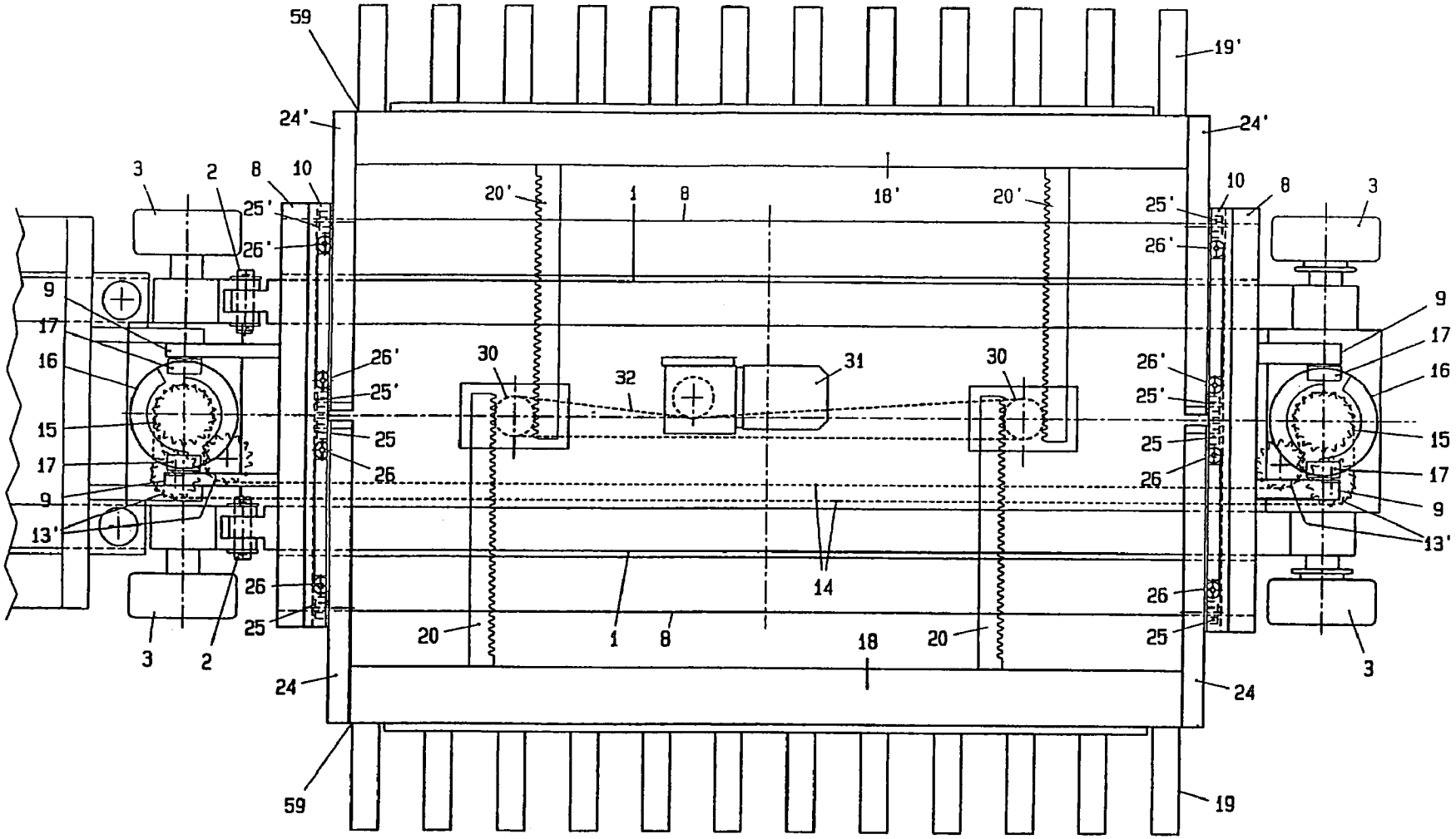
FIG. 4 is a plan view of an enlargement of one part of the carriage.

Referring to FIG. 2, when the dividing door 35 between the entrance bay and the multistorey car park is closed, the user drives the vehicle onto the entrance bay.

The photocells 33, together with the reflective mirrors 34, are positioned symmetrically and at a predefined distance relative to the longitudinal axis of the carriage in such a way that, when one of the wheels 22, 22', 23 and 23' of the motor vehicle comes too close to the said axis, the signal of one of the photocells is interrupted.

While a motor vehicle is moving in, whenever a photocell 35 is cut off the system control activates a light signal indicating to the user that he must modify the direction in which the motor vehicle is moving.

When the wheels, 22, 22' are positioned on the rest 55, the sensor 54 enables the stop signal.

As the vehicle is entering, the direction signalling made possible by the photocells 33 helps the user, while after the vehicle has come to a stop, the blocking of the rays of the photocells by one or more wheels is used as a safety lock for the carriage which, if it tried to position itself underneath the motor vehicle to transfer it, would hit one of the wheels of the vehicle.

Referring to FIGS. 3 to 8, after the motor vehicle has been correctly positioned in the entrance bay and the user has left the vehicle and initiated the parking operation, the doors 35 are opened and the carriage starts the cycle of transferring the motor vehicle by travelling from the handling platform to the entrance bay in the guide trench 53.

The position at which the carriage stops in the entrance bay is determined in such a way that the axis of the pair of supporting means 58 of the front wheels 22 and 22' of the motor vehicle coincides with the axis of the rests 54 on which the said wheels 22 and 22' have been positioned by the user.

Because the rear wheels 23 and 23' of the motor vehicle may be nearer to or further from the front wheels 22 and 22' depending on the wheelbase of the motor vehicle, the pair of supporting means 59 of the rear wheels 23 and 23' is made elongate in the direction of the longitudinal axis of the vehicle so that it can support the wheels 23 and 23' of the rear axle within the range of variations of the wheelbases of motor vehicles on the market.

Despite the use of signals to minimize the misalignment of the motor vehicle with respect to the longitudinal axis of the carriage as the user is driving in, the front left wheel 22, referring to the direction of movement of the vehicle, will undoubtedly be at a different distance from the longitudinal axis of the carriage than the front right wheel 22' and the same will go for the rear left wheel 23 as compared with the rear right wheel 23'.

The two pairs of wheel supporting means 58 and 59 begin the horizontal outward symmetrical movement.

The metal supports 19 and 19' fit underneath the wheels 22, 22', 23 and 23' into the free spaces between the fixed supports 28 of the wheels.

Figures 5, 6, 7, 8:
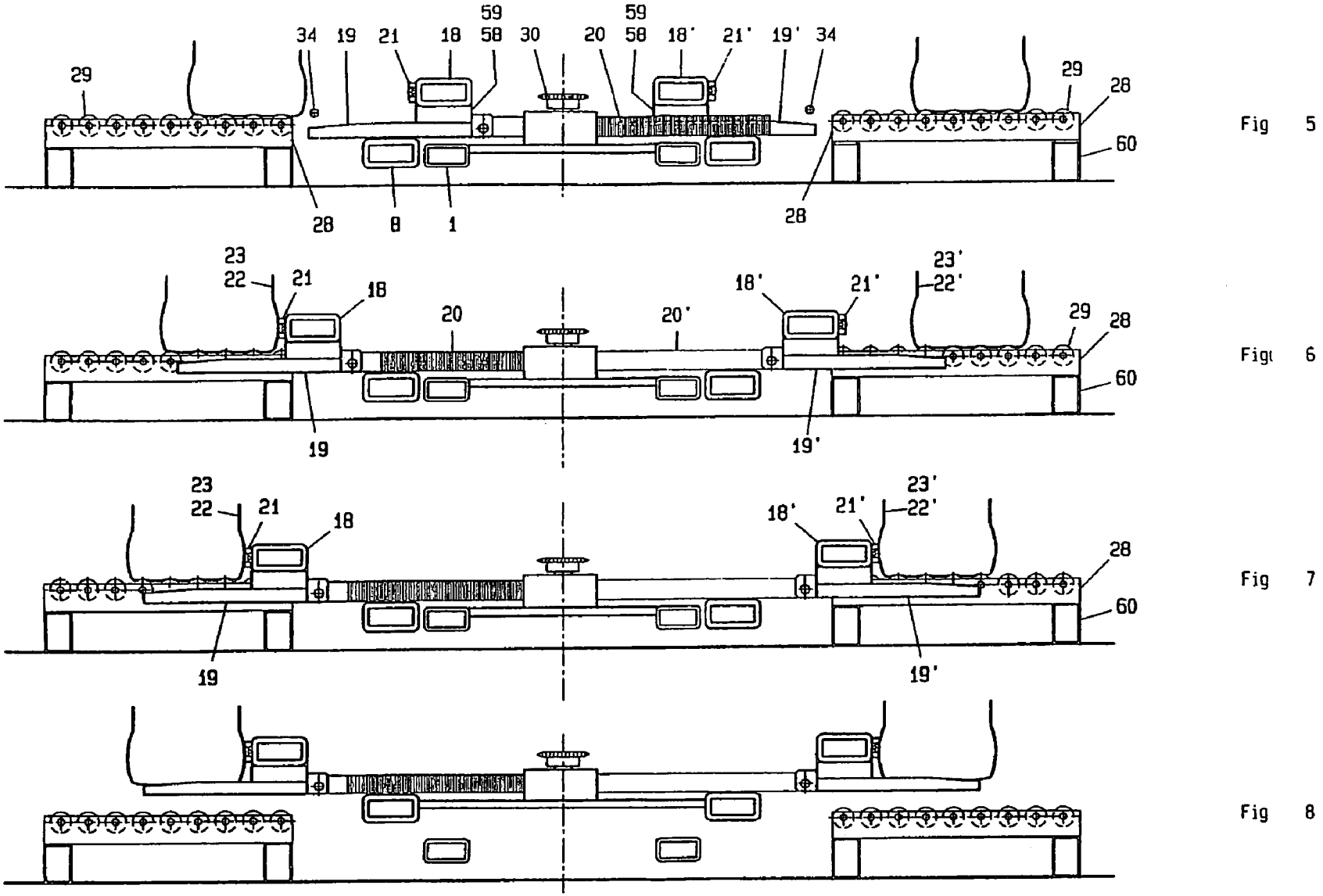
FIG. 5 is a cross section through the carriage positioned in the entrance bay with the means for supporting the wheels of the motor vehicle in the retracted position inside the carriage itself.
FIG. 6 is a cross section through the carriage positioned in the entrance bay with the means for supporting the wheels of the motor vehicle in a partially extended position and not raised.
FIG. 7 is a cross section through the carriage positioned in the entrance bay with the means for supporting the wheels of the motor vehicle in the extended position, that is after the vehicle has been centred, and not raised.
FIG. 8 is a cross section through the carriage positioned in the entrance bay with the means for supporting the wheels of the motor vehicle in the extended and raised position.
Figure 9:
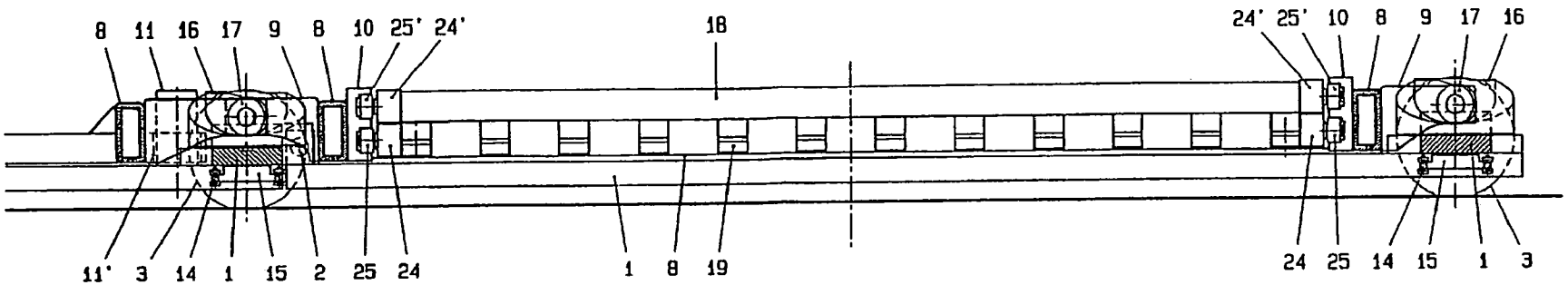
FIG. 9 is a side view, partially in longitudinal section, of one part of the carriage.

Continuing the horizontal outward movement, one of the centring bars 18 or 18'—bar 18 in FIG. 6—meets the side wall of the tyre of the corresponding wheel and pushes it out.

This operation is facilitated by the presence of the rollers 29 inserted in the fixed supports 28, which minimize the resistance to displacement of the wheel.

Continuing the horizontal outward movement, as shown in FIG. 7, the centring bar 18' which has hitherto not made contact, now meets the side wall of the tyre of the wheel 22', 23' of the motor vehicle.

At this point the longitudinal axis of the motor vehicle coincides with that of the carriage: the car has been "centred" by the same movement as enabled the wheel supporting means 58 and 59 to position the metal supports 19 and 19' beneath the four wheels 22, 22', 23 and 23' of the motor vehicle.

The horizontal outward movement of the motor vehicle wheel supporting means 58 and 59 stops when the vehicle is central, that is aligned with the longitudinal axis of the carriage, and this condition occurs when the pressure-sensitive tapes of variable-resistance conductive rubber 21 and 21' applied to the surface of each centring bar 18 and 18' that comes into contact with the motor vehicle tyre are simultaneously compressed, making them electrically conductive, thus enabling the said movement to be stopped.

The amount of horizontal outward movement of the motor vehicle wheel supporting means 58 and 59 is variable as a function of the inside tracks of the two wheels of each axle of the motor vehicle and, when this movement stops, the distance between the pressure-sensitive tapes 21 and 21' applied to the centring bars 18 and 18' is equal to the inside track of the wheels of the corresponding axle of the vehicle.

At this point the motor vehicle wheel supporting means 58 and 59, extended as described above and pressed against the tyres so as to clamp the wheels 22, 22', 23 and 23' and prevent them moving on their resting surface, are lifted by the rising of the frames 8.

Figure 10:
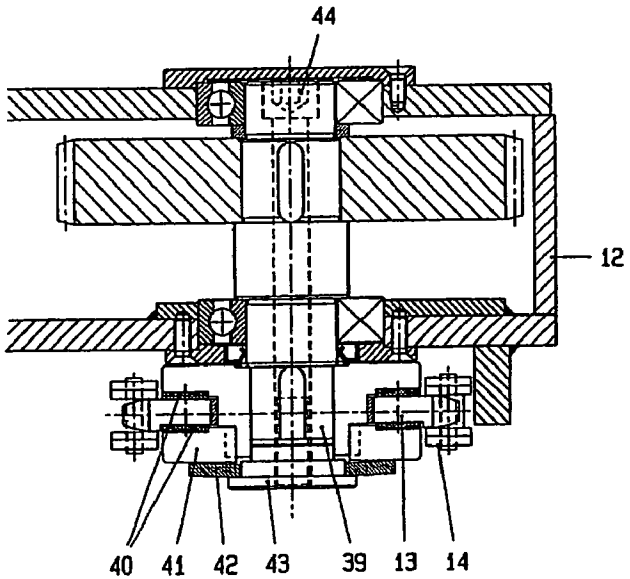
FIG. 10 is a cross section through a system, fitted to the carriage, for limiting the mass that is to be transferred, according to the invention.

To avoid transferring a vehicle whose mass is too great, unacceptable for example on the handling platform, the system shown in FIG. 10 is used to limit the amount of mass that can be lifted by limiting the force transmissible through the chain 14.

On the output shaft 39 of the lifting speed reducer 12, the toothed wheel 13, which passes the torque of the speed reducer 12 to the chain 24, is housed, by the friction rings 40, between a hub and an axially movable anchor 41 pressed via the spring 42 by a disc 43 which compresses the spring 42 by a controlled amount adjusted by means of the screw 44.

Depending on the force exerted by the spring 42 and the coefficient of friction of the friction rings 40, the toothed wheel 13 can transmit a variable force to the chain 14 to limit how much mass can be raised.

Once the vehicle is raised, the carriage can transfer it to the handling platform.

The job of the sensor 38 is to detect the presence or absence of the motor vehicle on the carriage.

Since the position of the wheels 22 and 22' of the front axle of the motor vehicle is stationary on the carriage, the sensors 36 positioned on the carriage on the longitudinal axis at predefined distances from the axle of the front wheels make it possible to determine whether the distance between the front axle and the front end of the motor vehicle is greater or less than certain preset values.

In the same way, the sensors 37 make it possible to determine whether the distance between the front axle and the back end of the motor vehicle is greater or less than certain preset values.

Figure 11:
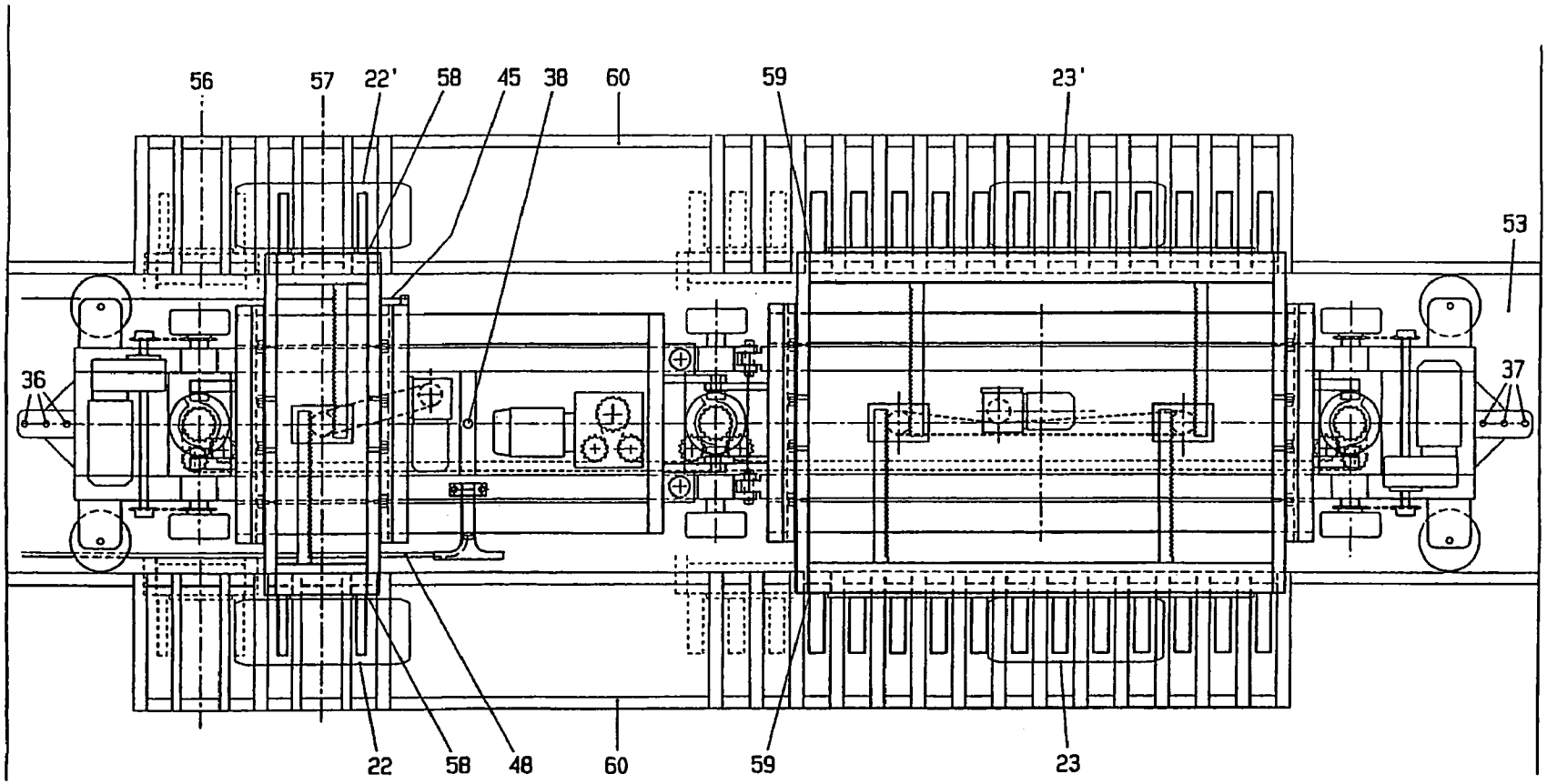
FIG. 11 is a plan view of the transfer carriage according to the invention, positioned in a parking bay, in the course of depositing or collecting the motor vehicle.

On the basis of the state of the sensors 36 and 37 and the data from the rotating electronic system 47, the system control can deposit the motor vehicle, as shown in FIG. 11, in a variety of positions, and in particular, if the distance between the front axle of the car and the front end is short, it can deposit the motor vehicle in such a way that its front axle coincides with the axis 56, whereas if this distance is large, it can deposit the motor vehicle in such a way that its front axle coincides with the axis 57.

The vehicle is deposited by lowering the wheel supporting means 58 and 59, by lowering the frame 8, in such a way that the metal supports 19 and 19' fit into the spaces between the fixed supports 28 of the frames 60 installed in the parking bays, allowing the wheels 22, 22', 23 and 23' to rest on the said fixed supports 28, after which the supporting means 58 and 59 can be withdrawn horizontally into the carriage in the rest position.

On the basis of the state of the sensor 38, the data of the rotating electronic system 47 and the lifting or lowering function of the motor vehicle wheel supporting means 58 and 59, the system control writes to memory whether the parking bay is empty or full.

In other words when the motor vehicle is present on the carriage and the carriage is inside a parking bay, in the right position for releasing or gripping the motor vehicle, the operation of lifting the frames 8 is always interpreted by the control as a collecting operation and hence the parking bay is stored in memory as empty, while the operation of lowering the frames 8 is always interpreted by the control as a depositing operation and hence the parking bay is stored in memory as full.

The invention claimed is:

1. A self-propelled carriage on wheels for transferring a motor vehicle by lifting wheels of the vehicle, the carriage comprising:

two parts that are joined together with a hinge, one of said two parts having four support wheels and another of said two parts having two support wheels, each of said two parts carrying the wheels of a respective axle of the vehicle being transferred; and each of said two parts comprising, a wheel lifting frame that moves vertically, a rotatable gear carried by said frame and engaging a pair of geared racks that move symmetrically and in opposite directions perpendicularly with respect to a longitudinal axis of the carriage, a pair of centering bars carried by said frame and that are parallel to the longitudinal axis of the carriage and that are each connected to a respective different one of said geared racks and that move in opposite directions perpendicular to the longitudinal axis of the carriage when impelled by said geared racks into engagement with interior sides of the wheels of the vehicle being transferred, and each of said centering bars having plural supports that extend parallel to said racks and that are arranged and adapted to engage a tread of a respective wheel of the vehicle being transferred, said centering bars and plural supports moving vertically with said frame to lift the vehicle.

2. The carriage of claim 1, further comprising a motor that drives a single chain that is connected to said frame of each of said two parts to move each said frame vertically.

3. The carriage of claim 1, wherein said one of said two parts comprises two of said rotatable gear and geared racks, which are spaced apart from each other longitudinally, and a motor that drives a single chain that drives both of said two rotatable gears.

* * * * *